US011763722B1

(12) United States Patent
Dai et al.

(10) Patent No.: US 11,763,722 B1
(45) Date of Patent: Sep. 19, 2023

(54) FLIP CHIP SPACE PIXEL ARRANGEMENT STRUCTURE, PIXEL MULTIPLEXING METHOD AND SYSTEM, APPARATUS AND STORAGE MEDIUM

(71) Applicant: Voxel Inc, West Sacramento, CA (US)

(72) Inventors: Zhiming Dai, Guangdong (CN); Haoyi Zhang, Guangdong (CN)

(73) Assignee: Voxel Inc, West Sacramento, CA (US)

( * ) Notice: Subject to any disclaimer, the term of this patent is extended or adjusted under 35 U.S.C. 154(b) by 0 days.

(21) Appl. No.: 18/131,401

(22) Filed: Apr. 6, 2023

(51) Int. Cl.
*G09G 3/20* (2006.01)
*G09G 3/32* (2016.01)

(52) U.S. Cl.
CPC ..... *G09G 3/2003* (2013.01); *G09G 3/2074* (2013.01); *G09G 3/32* (2013.01); *G09G 2300/0452* (2013.01); *G09G 2300/0465* (2013.01); *G09G 2310/0297* (2013.01); *G09G 2340/0457* (2013.01)

(58) Field of Classification Search
CPC ..... G09G 3/2003
See application file for complete search history.

(56) References Cited

U.S. PATENT DOCUMENTS

2022/0366845 A1* 11/2022 Kimura ..... H01L 27/1207

* cited by examiner

*Primary Examiner* — Gustavo Polo

(57) ABSTRACT

Provided is a flip chip space pixel arrangement structure, a pixel multiplexing method and system, an apparatus and a storage medium. The pixel multiplexing method includes: equidistantly dividing, in rows and columns, an LED display screen into a plurality of first element sets and a plurality of second element sets; on the basis of a pixel acquisition algorithm, sampling a single frame of original image having high resolution into seven basic images having low resolution; on the basis of a determination strategy, formulating display orders of the basic images, the single frame of original image corresponding to three display orders, and each of the display orders corresponding to one or more of the basic images; and on the basis of the display orders, sequentially displaying each of the basic images in a single frame duration, to complete sub-pixel reconstruction of the flip chip space pixel arrangement structure.

10 Claims, 5 Drawing Sheets

FLIP CHIP SPACE PIXEL ARRANGEMENT STRUCTURE, PIXEL MULTIPLEXING METHOD AND SYSTEM, APPARATUS AND STORAGE MEDIUM

TECHNICAL FIELD

The present application relates to the technical field of display devices, and in particular to a flip chip space pixel arrangement structure, a pixel multiplexing method and system, an apparatus and a storage medium.

BACKGROUND ART

In a flat panel display technology, a Micro (Mini) inorganic light emitting diode (LED) display is recognized as a fourth generation display technology after an LED display, an oxide light emitting diode (OLED) display and an LED board due to numerous advantages such as lightness and thinness, active lighting, a fast response speed, a wide angle of view, rich colors, high brightness, low power consumption and high and low temperature resistance, can have a panel having a large size and high resolution, and is the research focus of current manufacturers and the research and development direction of a display technology in the future.

With rapid development of the display technology, consumers also put forward high resolution and brightness requirements for display screens. A pixel arrangement structure of the existing display is as follows: red, green and blue sub-pixels are used and uniformly spaced to form a triangular mesh structure, and any three adjacent sub-pixels forming a triangle can form a white light pixel point. The structure provides a high pixel density, but with limitations of relevant factors such as a component size and a heat dissipation capability, sub-pixel arrangement has an upper density limit.

For a display panel having high resolution, distance requirements between sub-pixel light emitting regions will be increasingly smaller when resolution requirements are improved, and the structure illustrated above has certain limitations.

Therefore, a novel method is urgently required to increase a sub-pixel arrangement density, so as to satisfy the requirements of high resolution display.

SUMMARY

In order to solve one or more of the problems existing in the prior art, the present invention provides a flip chip space pixel arrangement structure and a pixel multiplexing method. The technical solution used by the present invention in order to solve the above problem is as follows: a pixel multiplexing method based on a flip chip space pixel arrangement structure includes:

S1, equidistantly dividing, in rows and columns, pixel points of a light emitting diode (LED) display screen into a plurality of first element sets (1) and a plurality of second element sets (2), the plurality of first element sets (1) and the plurality of second element sets (2) being arranged in a uniform array manner, the plurality of first element sets (1) and the plurality of second element sets (2) forming a light emitting tube array, the first element set including a plurality of first pixel points, the second element set including a plurality of second pixel points, the light emitting tube array being provided with a plurality of white light point groups, the white light point group including a first type of white light points (4) and a second type of white light points (5), the first type of white light points (4) including three white light points arranged inside the second element set (2), and two white light points arranged between the first pixel point and the second element set (2) that are adjacent to each other, and the second type of white light points (5) including two white light points arranged between the two adjacent second element sets (2);

S2, on the basis of a pixel acquisition algorithm, sampling an original image into seven single frame of basic images having low resolution lower than that of the original image, a pixel of each of the basic images being mapped in one-to-one correspondence with the same white light point of each of the white light point groups;

S3, on the basis of a determination strategy, formulating display orders of the basic images, the single frame of original image corresponding to three display orders, each of the display orders corresponding to one or more of the basic images, the display orders including an order I (61), an order II (62) and an order III (63), and the determination strategy being to determine dry pixel points generated by the basic images corresponding to the order I, the order II and the order III at the same time; and S4, according to the display orders, sequentially displaying each of the basic images in a single frame duration, to complete sub-pixel reconstruction of the flip chip space pixel arrangement structure.

By using the above technical solution, the first type of white light points is formed by the second element set, or generated by cooperation of the first pixel point and the second element set, and therefore light emitting of the first type of white light points may not affected when other second element sets emit light. The second type of white light points is white light points formed by cooperation of sub-pixel points in the two adjacent second element sets, requires the sub-pixel points corresponding to the two second element sets to all be in an idle state in the display order, or modulates interfering sub-pixel points, i.e. the common sub-pixel points, so as to enable the second type of white light points to simultaneously turn on when the adjacent first type of white light points turn on, thereby improving utilization of the white light point.

By means of the pixel acquisition algorithm, the original image having high resolution is split into seven basic images having low resolution, and the seven basic images having low resolution are combined to form an image having high resolution. In order to improve display efficiency, the seven split basic images correspond to different pixels of the original image and correspond to different white light points of the white light point group respectively. Specifically, after each of the basic images is properly translated, the vast majority of pixel points may overlap pixel points of other basic images. The first type of white light points and the second type of white light points may turn on in different display orders. For example, in the display order I, two first type of white light points that are non-adjacent simultaneously turn on, and are used for displaying two basic images. The seven images are displayed by the white light point group by means of the three display orders. Since a refresh rate of the basic image is high, human eyes generate a residual image when receiving the basic image, such that images of the three display orders are overlapped together, and therefore a high resolution effect is generated by means of the high refresh rate.

Optionally, the determination strategy includes:

determining whether a color difference between the corresponding first pixel point and the second pixel point adjacent to the first pixel point in the basic image is greater than a preset threshold;

under the condition of determining that the color difference between the corresponding first pixel point and the second pixel point adjacent to the first pixel point in the basic image is greater than the preset threshold, adjusting brightness of three sub-pixels of the first type of white light points (4) and brightness of the two adjacent first pixel points in the order II (62), to make a color of the second type of white light points (5) formed by the five sub-pixel points correspond to the basic image; and otherwise, canceling display of the second pixel point by the second type of white light points (5) in the order II (62), temporarily denoting the first pixel point as a similar pixel point, and adjusting display brightness of the first type of white light points (4) corresponding to the similar pixel point, an adjustment mode being to turn brightness up, the first pixel point being a pixel point of the first type of white light points (4) in the order I (61) in the white light point group corresponding to the same frame of original image, and the second pixel point being a pixel point of the second type of white light points (5) in the order II (62) in the white light point group corresponding to the same frame of original image.

By using the above technical solution, the pixel is usually a chip for controlling the scanning drive circuit since the pixel is driven by a driver. In order to reduce cost, reduce heat generation, and increase a pixel density, the present solution combines a plurality of monochromatic sub-pixels into a pixel set, and the single driver is used for driving the single pixel set. That is, as long as pixel points of the seven basic images sequentially correspond to the white light points of the white light point group, and the single driver may sequentially perform driving without separately driving. The driver is correspondingly provided with a buffer, and the buffer may store the seven frame of basic image split from each frame of original image. Since there is mutual interference of the pixel points when the second type of white light points are in use, a controller reads, before display, two interfering basic images corresponding to the order I and the order II from the buffer for comparison, so as determine whether the color difference between the first pixel point and the second pixel point at an interference position is greater than the preset threshold, and if so, a sub-pixel common by the first type of white light points of the order II and the second type of white light points of the order II is decided, and light intensity of the sub-pixel is modulated to reduce color shift, which is based on the principle that the human eyes are limited in resolution, and may mix adjacent pixel points, thereby generating illusion of a high color level. By the same reasoning, if the difference is small, display brightness of the original first pixel point is improved, and similar to the principle of pulse-width modulation (PWM), two adjacent frames each use single brightness, and use double brightness at intervals, and a visual effect is actually extremely close. By combining display of the similar pixel point, computation of the controller may be reduced, and the number of times of charging and discharging of a circuit may be reduced, thereby achieving the effect of power saving.

Optionally, the determination strategy includes:

determining whether a color difference between a corresponding third pixel point and the second pixel point adjacent to the third pixel point in the basic image is greater than a preset threshold;

under the condition of determining that the color difference between the corresponding third pixel point and the second pixel point adjacent to the third pixel point in the basic image is greater than the preset threshold, adjusting brightness of three sub-pixels of the first type of white light points (4) and brightness of the two adjacent third pixel points in the order II (62), to make a color of the second type of white light points (5) formed by the five sub-pixel points correspond to the basic image; and otherwise, canceling display of the second pixel point by the second type of white light points (5) in the order II (62), temporarily denoting the third pixel point as a similar pixel point, and adjusting display brightness of the first type of white light points (4) corresponding to the similar pixel point, an adjustment mode being to turn brightness up, the second pixel point being a pixel point of the second type of white light points (5) in the order II (62) in the white light point group corresponding to the same frame of original image, and the third pixel point being a pixel point of the first type of white light points (4) in the order III (63) in the white light point group corresponding to the same frame of original image.

By using the above technical solution, the pixel is usually a chip for controlling the scanning drive circuit since the pixel is driven by a driver. In order to reduce cost, reduce heat generation, and increase a pixel density, the present solution combines a plurality of monochromatic sub-pixels into a pixel set, and the single driver is used for driving the single pixel set. That is, as long as pixel points of the seven basic images sequentially correspond to the white light points of the white light point group, and the single driver may sequentially perform driving without separately driving. The driver is correspondingly provided with a buffer, and the buffer may store the seven frame of basic image split from each frame of original image. Since there is mutual interference of the pixel points when the second type of white light points are in use, a controller reads, before display, two interfering basic images corresponding to the order III and the order II from the buffer for comparison, so as determine whether the color difference between the third pixel point and the second pixel point at an interference position is greater than the preset threshold, and if so, a sub-pixel common by the first type of white light points of the order II and the second type of white light points of the order II is decided, and light intensity of the sub-pixel is modulated to reduce color shift, which is based on the principle that the human eyes are limited in resolution, and may mix adjacent pixel points, thereby generating illusion of a high color level. By the same reasoning, if the difference is small, display brightness of the original third pixel point is improved, and similar to the principle of pulse-width modulation (PWM), two adjacent frames each use single brightness, and use double brightness at intervals, and a visual effect is actually extremely close. By combining display of the similar pixel point, computation of the controller may be reduced, and the number of times of charging and discharging of a circuit may be reduced, thereby achieving the effect of power saving.

Optionally, the determination strategy includes:

determining whether a color difference between a corresponding third pixel point and the second pixel point adjacent to the third pixel point in the basic image is greater than a preset threshold, and determining whether a color difference between the corresponding first pixel point and the second pixel point adjacent to the first pixel point in the basic image is greater than a preset threshold;

under the condition of determining that the color difference between the corresponding third pixel point and the second pixel point adjacent to the third pixel point in the basic image is greater than the preset threshold, and the color difference between the corresponding first pixel point and the second pixel point adjacent to the first pixel point in the basic image is greater than the preset threshold, adjusting brightness of three sub-pixels of the first type of white light points (4) and brightness of the two adjacent third pixel points in the order II (62), to make a color of the second type of white light points (5) formed by the five sub-pixel points correspond to the basic image; and under the condition that any one or two of determinations are no, canceling display of the second pixel point by the second type of white light points (5) in the order II (62), comparing a color difference between a pixel point in the order I (61) or the order III (63) and the second pixel point, temporarily denoting a pixel point having a color difference comparison value less than or equal to a preset threshold as a similar pixel point, and adjusting display brightness of the first type of white light points (4) corresponding to the similar pixel point, an adjustment mode being to turn brightness up, the first pixel point being a pixel point of the first type of white light points (4) in the order I (61) in the white light point group corresponding to the same frame of original image, the second pixel point being a pixel point of the second type of white light points (5) in the order II (62) in the white light point group corresponding to the same frame of original image, and the third pixel point being a pixel point of the first type of white light points (4) in the order III (63) in the white light point group corresponding to the same frame of original image.

By using the above technical solution, the above two determination strategies are integrated, interfering pixel points produced by the basic images corresponding to the light emitting order I, the second light emitting order II, and the third light emitting order III are determined at the same time, so as to combine display of the similar pixel point as much as possible, reduce computation of the controller, and reduce the number of times of charging and discharging of the circuit, thereby achieving the effect of power saving.

Optionally, the adjusting brightness of three sub-pixels of the first type of white light points (4) and brightness of the two adjacent third pixel points in the order II (62), to make a color of the second type of white light points (5) formed by the five sub-pixel points correspond to the basic image includes:

T1, obtaining mapping relations between three primary colors of the second pixel point and the similar pixel point and three primary color sub-pixels of corresponding white light points;

T2, obtaining primary color rendering data of a three primary color sub-pixel of each of white light points of the order II (62) on the basic image, adding primary color rendering data corresponding to common sub-pixels of the white light points, and then dividing a sum by 2 to obtain primary color rendering data of the common sub-pixel in the order II (62); and T3, on the basis of a scanning drive circuit, transmitting adjusted sub-pixel point color rendering data and unadjusted sub-pixel point color rendering data of each of the white light points in the order II (62) to the display screen, so as to control each of the corresponding white light points to emit light.

By using the above technical solution, in two interfering white light points, there are four independent sub-pixels, and one sub-pixel (i.e., the interfering sub-pixel) common by the first type of white light points and the second type of white light points, the primary color rendering data of the two basic images corresponding to the two white light points is obtained, and the common sub-pixel is displayed as an average value of the color rendering data of the two basic images. In actual use, color information that may be received by the eyes is an average value of emitted light in a period of time, and therefore by means of the method, accuracy of performance of the color may be improved while the pixel density is increased.

The present application further discloses a flip chip space pixel arrangement structure using the above method. The flip chip space pixel arrangement structure includes: several first element sets (1) and several second element sets (2), where the first element set (1) includes several first pixel points arranged continuously and longitudinally, the first pixel point being denoted as a pixel A, and the second element set (2) includes a center pixel point (201), a first unit pixel (202), a second unit pixel (203), a third unit pixel (204) and a fourth unit pixel (205), a first sub-pixel, a second sub-pixel, a third sub-pixel and a fourth sub-pixel being sequentially distributed on a semi-circular arc established by taking the center pixel point (201) as a circle center, the sub-pixel on the semi-circular arc being denoted as a circular arc sub-pixel, the center pixel point (201), the first unit pixel (202), the second unit pixel (203), the third unit pixel (204) and the fourth unit pixel (205) being denoted as a pixel A, a pixel B, a pixel C, a pixel B and a pixel C respectively, and a red light sub-pixel, a green light sub-pixel and a blue light sub-pixel each corresponding to one of the pixel A, the pixel B and the pixel C;

three separate white light points (301) are arranged in each of the second element sets (2), the separate white light point (301) is formed by cooperation of the center pixel point (201) and any one of the circular arc sub-pixels, and the circular arc sub-pixel participating in composition is adjacent to the center pixel point (201);

the second element set (2) is arranged between the two adjacent first element sets (1), the first unit pixel (202) and the second unit pixel (203), the third unit pixel (204) and the fourth unit pixel (205) are used as reconstruction pairs respectively, the flip chip space pixel arrangement structure forms a reconstruction location on one side of the reconstruction pair away from the center pixel point (201), and the pixel A in the first element set (1) is arranged on the reconstruction location, and match the reconstruction pair adjacent to the pixel A, to form a reconstruction white light point I (302); and control modes of the first element set (1) and the second element set (2) are both separate electric control, to further control an on-off order and frequency of the separate white light point (301) and the reconstruction white light point I (302).

By using the above technical solution, the single second element set consists of five sub-pixels, and forms three separate white light emitting points inside, and each of the white light emitting points is surrounded by one pixel A, one pixel B and one pixel C. That is, three groups of reds, greens and blues (RGBs) form the three white light emitting points, and the white light emitting point is generated without matching the first element set, and therefore is referred to as a separate light emitting point. Moreover, each of the reconstruction pairs may match a pixel on the first element set adjacent to the reconstruction pair, to form the reconstruction white light point I. That is, one sub-pixel point is additionally increased, and one white light point is at least obtained, which is conducive to increase in the pixel density and further reduces power consumption of a whole panel compared with the related art II.

The second element set is located between the adjacent first pixel points, and therefore a rule of arrangement of the first pixel point-the second element set-the first pixel point is presented in a lateral direction, the plurality of white light points are arranged continuously and uniformly in the lateral direction, and a distance between the adjacent white light points and a distance between sub-pixels are on the same order or even the same, such that graininess of the pixel is significantly reduced, and the requirements of an electronic device and a high-definition image signal source for high resolution and high brightness of the display screen may be better satisfied.

In addition, the same type of sub-pixels in the present solution are staggered from each other and not arranged on the same straight line, thereby being conducive to color mixing of pixels in a unit panel size, improving expressiveness of a curve and an oblique line, ensuring increase in the pixel density, and simultaneously reducing a cross-color phenomenon between pixels.

In the related art, on-off of each of the pixels needs to be controlled by the driver, on-off of the white light point is controlled by on-off of the sub-pixel, and the sub-pixel is subjected to PWM, so as to control brightness of the white light point. That is, in the related art, three sub-pixel points or four sub-pixel points are driven by one driver. In the present solution, five separate light emitting points in the second element set are driven by a group of drivers, so as to enable the second element set to continuously and repeatedly emit white light, thereby prolonging a light emitting period. The pixel A in the first element set is also controlled by a drive, so as to match a drive of the second pixel, to control on-off and light intensity of the reconstruction white light point.

For a liquid crystal display (LCD) technology or oxide light emitting diode (OLED) technology, a pixel point may be controlled by means of a thin film transistor (TFT), and the TFT is usually made of metal oxide for control of liquid crystal or light emitting oxide, is of a thin film structure, is usually located on a light path, has certain light transmittance, and is provided with a light transmission opening. That is, the denser the pixel is, the smaller the light transmission opening is if a size of the drive is unchanged. Therefore, the number of drives restricts display quality. In the present solution, the drive may be arranged on a back surface of the pixel, and therefore the number of the drives does not influence amount of light transmission, and a wide range of drivers may be used with the high pixel density, to increase a wide range of display indexes.

In addition, in the OLED technology, diamond arrangement and RGB delta pixel arrangement of a RGB sub-pixel point of the related art are superficially approximate to the present solution, but in fact, there are substantial differences. The diamond arrangement and the RGB delta pixel arrangement aims to solve the problem of large differences in RGB sub-pixel lives of an OLED, which is commonly known as the problem of screen burning. Thus, the RGB delta pixel arrangement may largely configure areas of a blue light sub-pixel having a short life and a red light sub-pixel having a short life, so as to compensate for the color difference. Moreover, reduction in the pixel density may be caused after the diamond arrangement or the RGB delta pixel arrangement is used. In the present solution, use of the arrangement mode aims to solve the problem of the low pixel density, since the lives of the red light sub-pixel, a green light sub-pixel and the blue light sub-pixel are close, there is not limitation to corresponding relations between the pixel A, the pixel B and the pixel C and the red light sub-pixel, the green light sub-pixel and the blue light sub-pixel, and only one-to-one correspondence is required. That is, there may be six corresponding relations, which may not be done in the diamond arrangement and the RGB delta pixel arrangement. Similarly, configuration areas of the pixel A, the pixel B and the pixel C are also close, and therefore dense arrangement may be made, which may not be done in the diamond arrangement and the RGB delta pixel arrangement.

Optionally, the center pixel point and any a pair of adjacent sub-pixels on the corresponding semi-circular arc form a 60° central angle, and the reconstruction pair and the pixel A on the corresponding reconstruction location are arranged in an equilateral triangle.

By using the above technical solution, an equilateral triangle is formed by the first unit pixel, the second unit pixel and the center pixel point, an equilateral triangle is formed by the second unit pixel, the third unit pixel and the center pixel point, an equilateral triangle is formed by the third unit pixel, the fourth unit pixel and the center pixel point. In other words, if the first unit pixel, the second unit pixel, the third unit pixel, the fourth unit pixel, the center pixel point and the first unit pixel are sequentially connected, an isosceles trapezoid is formed, two end points of a bottom edge of the isosceles trapezoid are the first unit pixel and the fourth unit pixel, and two end points of a top edge of the isosceles trapezoid are the second unit pixel and the third unit pixel. Since the reconstruction pair and the pixel A on the corresponding reconstruction location are arranged in an equilateral triangle, the separate white light point and the reconstruction white light point I are uniformly arranged, a space pixel is not distorted compared with other angular arrangement modes, or there is no need to adjust a hue position in order to correct distortion, and no need to shift the space pixel by a control system.

Optionally, the second element set (2) is arranged between the two adjacent first element sets (1), and is arranged in a single-row longitudinal manner;

in the two second element sets (2) vertically adjacent to each other, the first unit pixel (202), the second unit pixel (203), the third unit pixel (204) and the fourth unit pixel (205) of the second element set (2) located above and the second unit pixel (203) and the third unit pixel (204) of the second element set (2) located below form a shape of a regular hexagon, four sub-pixels on a lower side of the regular hexagon match the pixel A at a center of the regular hexagon, to form three reconstruction white light points II (303), and the two adjacent second element sets (2) control on-off of pixels inside the second element sets respectively, to further control an on-off order and frequency of the reconstruction white light point II (303); and the four sub-pixels on the lower side of the regular hexagon are divided into two matched pairs according to left and right pairing, the matched pair matches the pixel A in the reconstruction location adjacent to the matched pair, to form a reconstruction white light point III (304), the two adjacent second element sets (2) control on-off of pixels inside the second element sets respectively, and the first element set (1) controls on-off of the pixel A inside the first element set, to further control on-off of the reconstruction white light point III (304).

By using the above technical solution, the two adjacent second element sets may spatially re-emit white light three times, and each of the reconstruction white light points II has a pixel set of 1R1G1B, a sub-pixel ratio of 1:1:1 and a white light mixture of 3:6:1. A distance of the white light emitting point is uniform in a lateral direction and a longitudinal direction, and pixel arrangement is uniform, thereby avoiding visual pixel graininess. In addition, the second element set emits white light three times, and the second element set adjacent to the second element set may repeatedly emit white light, so as to obtain the high pixel density, thereby improving resolution of a panel, and also improving modulation capability of light emitting of the single pixel set.

Optionally, the pixel A is a red light sub-pixel, the pixel B is a blue light sub-pixel, and the pixel C is a green light sub-pixel;

optionally, the pixel A is a red light sub-pixel, the pixel B is a green light sub-pixel, and the pixel C is a blue light sub-pixel;

optionally, the pixel A is a blue light sub-pixel, the pixel B is a red light sub-pixel, and the pixel C is a green light sub-pixel;

optionally, the pixel A is a blue light sub-pixel, the pixel B is a green light sub-pixel, and the pixel C is a red light sub-pixel;

optionally, the pixel A is a green light sub-pixel, the pixel B is a red light sub-pixel, and the pixel C is a blue light sub-pixel; and optionally, the pixel A is a green light sub-pixel, the pixel B is a blue light sub-pixel, and the pixel C is a red light sub-pixel.

Further, the present application further discloses a pixel multiplexing system based on a flip chip space pixel arrangement structure based on the above method. The pixel multiplexing system includes: a partitioning module, the partitioning module being used for equidistantly dividing, in rows and columns, an LED display screen into several first element sets (1) and several second element sets (2) that are arranged in a uniform array manner, to form a light emitting tube array, the light emitting tube array forming a plurality of white light point groups, the white light point group including a first type of white light points (4) and a second type of white light points (5), the first type of white light points (4) including three white light points arranged inside the second element set (2), and two white light points arranged between the first pixel point and the second element set (2) that are adjacent to each other, and the second type of white light points (5) including two white light points arranged between the two adjacent second element sets (2);

a splitting module, the splitting module sampling, by means of a pixel acquisition algorithm, an original image into seven single frame of basic images having low resolution lower than that of the original image, and a pixel of each of the basic images being mapped in one-to-one correspondence with the same white light point of each of the white light point groups;

a sorting module, the sorting module formulating display orders of the basic images by means of a determination strategy, the single frame of original image corresponding to three display orders, each of the display orders corresponding to one or more of the basic images, the display orders including an order I, an order II and an order III, and the determination strategy being to determine dry pixel points generated by the basic images corresponding to the order I, the order II and the order III at the same time; and a control module, the control module sequentially displaying, by means of the display orders, each of the basic images in a single frame duration, to complete sub-pixel reconstruction of the flip chip space pixel arrangement structure.

Further, a host provided by the present application uses the following technical solution:

the host includes a memory and a processor, where the memory stores a computer program loadable by the processor and executing the pixel multiplexing method as above.

Further, a readable storage medium provided by the present application uses the following technical solution:

the readable storage medium stores a computer program loadable by a processor and executing the pixel multiplexing method as above.

The present application achieves the beneficial values: 1. the present solution divides the original image having high resolution that needs to be displayed into the plurality of basic images having low resolution that are staggered from each other, and displays the basic image separately at different orders, so as to avoid the problem of mutual interference of the common pixel point, thereby improving utilization of the type of the screen having a high pixel density, and improving resolution of the screen.

2. The present solution changes an arrangement structure of a Micro-LED/Mini-LED pixel, such that the white light emitting point formed by the RGB sub-pixel is uniformly arranged, and visual pixel graininess is avoided, thereby obtaining the high pixel density, and further improving resolution of the panel; and moreover, the present solution increases a distance between different colors of sub-pixels, improves pixel color mixing in a unit panel size, improves performance of the curve and the oblique line, to reduce cross-color between pixels, and reduces power consumption of the whole display panel at the same sub-pixel density.

3. The present solution further reduces a cost compared with a traditional pixel arrangement solution, and by means of space reconstruction of the sub-pixel, improves a physical RGB pixel group, reduces an average physical cost of a single group of pixels, and effectively improves cost performance of a product.

Figure 1:
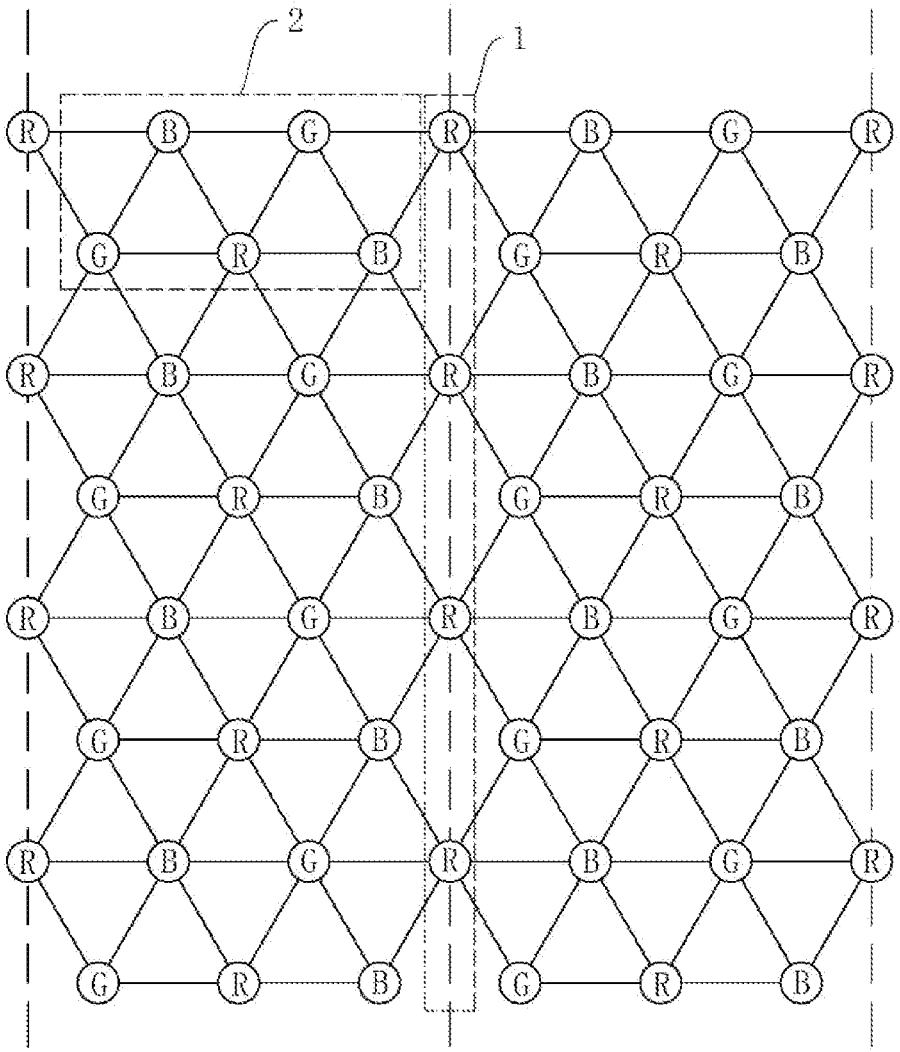
FIG. 1 is a schematic structural diagram of a flip chip space pixel arrangement structure in an example of the present application.

Description of reference numerals:

1, first element set; 2, second element set; 201, center pixel point; 202, first unit pixel; 203, second unit pixel; 204, third unit pixel; 205, fourth unit pixel; 301, separate white light point; 302, reconstruction white light point I; 303, reconstruction white light point II; 304, reconstruction white light point III; 4, first type of white light points; 41, white light point I; 42, white light point II; 43, white light point III; 44, white light point IV; 45, white light point V; 5, second type of white light points; 51, white light point VI; 52, white light point VII; 61, order I; 62, order II; and 63, order III.

DETAILED DESCRIPTION OF THE EMBODIMENTS

To enable the objectives, features, and advantages mentioned above of the present invention to be more apparent and easily understood, specific embodiments of the present invention will be described in detail below with reference to the drawings. Many specific details are set forth in the following description to facilitate full understanding of the present invention. However, the present invention may be implemented in many other ways different from those described herein, similar improvements may be made by those skilled in the art without departing from the connotation of the present invention, and therefore the present invention is not limited by particular examples disclosed below.

Unless explicitly defined, the terms "one", "a" and "the" are not intended to refer to a singular entity, but include general categories whose specific examples can be used for illustration. Therefore, the use of the term "one" or "a" may be intended to refer to any number of at least one, including "a", "one or more", "at least one" and "one or more". The term "or" is intended to refer to any of options and any combination of the options, including all the options, unless the options are explicitly indicated to be mutually exclusive. The phrase "at least one of", when combined with an item list, refers to a single item in a list or any combination of items in the list. The phrase does not require all the items listed, unless expressly defined as such.

An example of the present application discloses a flip chip space pixel arrangement structure. The flip chip space pixel arrangement structure is used for the field of Micro-light emitting diode (LED) or Mini-LED self-light-emitting display. With reference to FIG. 1, the flip chip space pixel arrangement structure is divided according to a driving relation, and includes a plurality of first element sets 1 and a plurality of second element sets 2, where the first element set 1 includes several first pixel points arranged continuously, the first pixel point being a pixel A. Since a substrate and a product type are different, in some examples, a first element set 1 may be arranged in a single row of curves, and in another examples, a first element set 1 may be arranged in a single row of straight lines as long as two adjacent groups of first element sets 1 are parallel to each other or coincide by translation.

Figure 2:
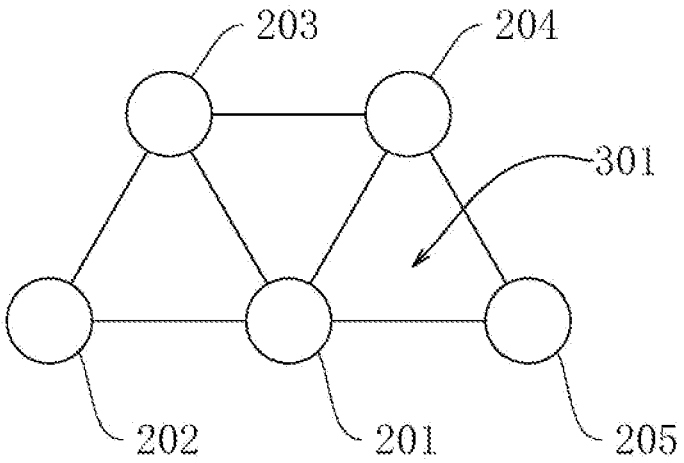
FIG. 2 is a schematic structural diagram of a second element set in some examples of the present application.

With reference to FIGS. 1 and 2, a plurality of second element sets 2 are arranged between two adjacent first element sets 1. Specifically, each of the second element sets 2 is arranged in an extension direction of the first element set 1. The second element set 2 includes a center pixel point 201 and a first unit pixel 202, a second unit pixel 203, a third unit pixel 204, and a fourth unit pixel 205 taking the center pixel point 201 as a circle center and sequentially distributed on a semi-circular arc, where the center pixel point 201, the first unit pixel 202, the second unit pixel 203, the third unit pixel 204 and the fourth unit pixel 205 are a pixel A, a pixel B, a pixel C, a pixel B and a pixel C respectively.

The pixel A, the pixel B and the pixel C are one of a red light sub-pixel, a green light sub-pixel and a blue light sub-pixel respectively. Compared with an oxide light emitting diode (OLED), areas of a red light sub-pixel, a blue light sub-pixel and a green light sub-pixel are the same without compensatory increase in light emitting areas of the blue light sub-pixel and the red sub-pixel, and therefore corresponding relations between the pixel A, the pixel B and the pixel C and the green light sub-pixel, the blue light sub-pixel, and the red light sub-pixel may be differently selected in different examples. Specifically, in some examples, a pixel A is a red light sub-pixel, a pixel B is a blue light sub-pixel, and a pixel C is a green light sub-pixel; in another examples, a pixel A is a red light sub-pixel, a pixel B is a green light sub-pixel, and a pixel C is a blue light sub-pixel; in another examples, a pixel A is a blue light sub-pixel, a pixel B is a red light sub-pixel, and a pixel C is a green light sub-pixel; in another examples, a pixel A is a blue light sub-pixel, a pixel B is a green light sub-pixel, and a pixel C is a red light sub-pixel; in another examples, a pixel A is a green light sub-pixel, a pixel B is a red light sub-pixel, and a pixel C is a blue light sub-pixel; and in another examples, a pixel A is a green light sub-pixel, a pixel B is a blue light sub-pixel, and a pixel C is a red light sub-pixel. Unlimitedly, this example takes the pixel A as the red light sub-pixel, the pixel B as the blue light sub-pixel, and the pixel C as the green light sub-pixel as an example.

A central angle formed by the center pixel point 201 and any a pair of adjacent sub-pixels on the corresponding semi-circular arc may be different. In some examples, a 65° central angle, a 55° central angle or other non-60° central angle may be formed. Since a triangle formed by the center pixel point 201 and an adjacent pair of sub-pixels on the corresponding semi-circular arc is not an equilateral triangle, a space pixel may be distorted, and in order to correct distortion, a hue position needs to be adjusted, and the space pixel may be shifted by means of a control system. In order to reduce amount of computation of the control system, in some examples, the center pixel point 201 and any a pair of adjacent sub-pixels on the corresponding semi-circular arc form a 60° central angle.

That is, an equilateral triangle is formed by the first unit pixel 202, the second unit pixel 203 and the center pixel point 201, an equilateral triangle is formed by the second unit pixel 203, the third unit pixel 204 and the center pixel point 201, and an equilateral triangle is formed by the third unit pixel 204, the fourth unit pixel 205 and the center pixel point 201. In other words, if the first unit pixel 202, the second unit pixel 203, the third unit pixel 204, the fourth unit pixel 205, the center pixel point 201 and the first unit pixel 202 are sequentially connected, an isosceles trapezoid is formed, two end points of a bottom edge of the isosceles trapezoid are the first unit pixel 202 and the fourth unit pixel 205, and two end points of a top edge of the isosceles trapezoid are the second unit pixel 203 and the third unit pixel 204.

Therefore, three separate white light points 301 are formed in the second element set 2, and the separate white light point 301 is formed by cooperation of the center pixel point 201 and any adjacent pixel on the corresponding semi-circular arc. Each of the white light emitting points is surrounded by one pixel A, one pixel B and one pixel C. That is, three groups of reds, greens and blues (RGBs) form the three white light emitting points, and the white light emitting point is generated without matching the first element set 1, and therefore is referred to as a separate light emitting point.

Figure 3:
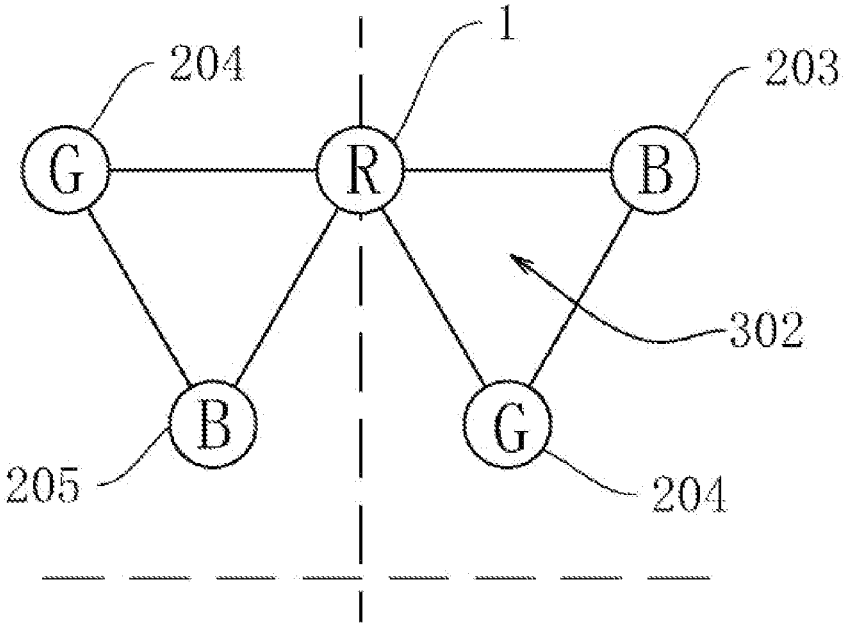
FIG. 3 is a schematic diagram, used for showing a matching relation between a first element set and a second element set in some examples, of the present application.

With reference to FIGS. 1 and 3, the first unit pixel 202 and the second unit pixel 203, the third unit pixel 204 and the fourth unit pixel 205 form reconstruction pairs respectively, the flip chip space pixel arrangement structure forms a reconstruction location on one side of the reconstruction pair away from the center pixel point 201, and the pixel A in the first element set 1 is arranged on the reconstruction location, and match the reconstruction pair adjacent to the pixel A, to form a reconstruction white light point I 302. Further, the reconstruction pair and the pixel A on the corresponding reconstruction location are arranged in an equilateral triangle. A rule of arrangement of the first element set 1-the second element set 2-the first element set 1 is presented in a lateral direction, the plurality of white light points are arranged continuously and uniformly in the lateral direction, and a distance between the adjacent white light points and a distance between sub-pixels are the same, such that graininess of the pixel is significantly reduced, and the requirements of an electronic device and a high-definition image signal source for high resolution and high brightness of the display screen may be better satisfied.

Moreover, each of the reconstruction pairs may match a pixel on the first element set 1 adjacent to the reconstruction pair, to form the reconstruction white light point I 302. That is, one sub-pixel point is additionally increased, and one white light point is at least obtained, which is conducive to increase in the pixel density and further reduces power consumption of a whole panel compared with the related art II.

Figure 4:
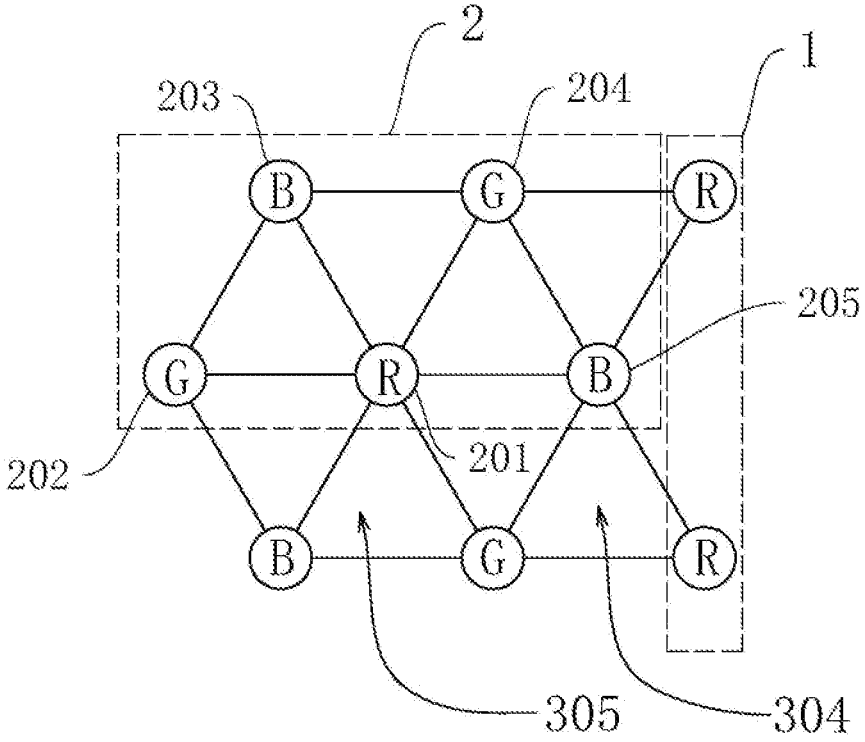
FIG. 4 is a schematic diagram, used for showing a matching relation between two adjacent second element sets in some examples, of the present application.

With reference to FIG. 4, for any two second element sets 2 that are vertically adjacent to each other, a relative distance between the two second element sets may be different in different examples. In order to avoid distortion of a space pixel, in some examples, a first unit pixel 202, a second unit pixel 203, a third unit pixel 204 and a fourth unit pixel 205 of the second element set 2 located above and a second unit pixel 203 and a third unit pixel 204 of the second element set 2 located below form a regular hexagonal structure, and four sub-pixels on a lower portion of the regular hexagonal structure match the pixel A at a center of the regular hexagonal structure, to form three reconstruction white light points II 303. Thus, all of the sub-pixels of the first element set 1 and the second element set 2 are uniformly arranged in a mesh manner as a whole.

Control modes of the first element set 1 and the second element set 2 are both separate electric control, to control an on-off order and frequency of the separate white light point 301 and the reconstruction white light point I 302, and the two adjacent second element sets 2 control on-off of pixels inside the second element sets respectively, to control an on-off order and frequency of the reconstruction white light point II 303. Specifically, on-off of each of the pixels needs to be controlled by the driver, on-off of the white light point is controlled by on-off of the sub-pixel, and the sub-pixel is subjected to pulse-width modulation (PWM), so as to control brightness of the white light point. In the present solution, five separate light emitting points in the second element set 2 are driven by a group of drivers, so as to enable the second element set 2 to continuously and repeatedly emit white light, thereby prolonging a light emitting period. The pixel A in the first element set 1 is also controlled by a drive, so as to match a drive of the second pixel, to control on-off and light intensity of the reconstruction white light point.

With reference to FIG. 4, a RGB region is also formed by adjacent sub-pixels of two adjacent second element sets 2, to form a white light point. Specifically, four sub-pixels in a lower portion of the above regular hexagonal structure are divided into two matched pairs left and right. That is, a first unit pixel 202 of the second element set 2 above and a second unit pixel 203 of the second element set 2 below form the matched pair, and a fourth unit pixel 205 of the second element set 2 above and the second unit pixel 203 of the second element set 2 below form the matched pair. The matched pair matches the pixel A on the reconstruction location adjacent to the matched pair, to form a reconstruction white light point III 304, and the two adjacent second element sets 2 control on-off of pixels inside the second element sets respectively, and match controlling of on-off of the pixel A inside the first element set by the first element set 1, thereby controlling on-off of the reconstruction white light point III 304.

Figure 5:
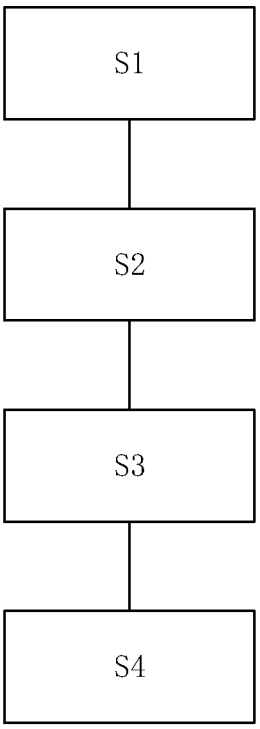
FIG. 5 is a block diagram of a pixel multiplexing method based on a flip chip space pixel arrangement structure in an example of the present application.

Specifically, in order to make full use of the flip chip space pixel arrangement structure, the present application further discloses a pixel multiplexing method based on a flip chip space pixel arrangement structure. The pixel multiplexing method is used for controlling sub-pixel point light emitting on an LED display screen, so as to control a white light point to emit light as much as possible in as few display frequencies as possible without interference. With reference to FIG. 5, the pixel multiplexing method at least includes four steps of S1-S4.

S1, equidistantly divide, in rows and columns, an LED display screen into a plurality of first pixel points and a plurality of second element sets 2 that are arranged in a uniform array manner, to form a light emitting tube array, the light emitting tube array forming a plurality of white light point groups, and each of the white light point groups including three first type of white light points 4 formed inside each of the second element sets 2, two first type of white light points 4 formed between the first pixel point and the second pixel set 2 that are adjacent to each other, and two second type of white light points 5 formed between the two adjacent second element sets 2.

Figure 6:
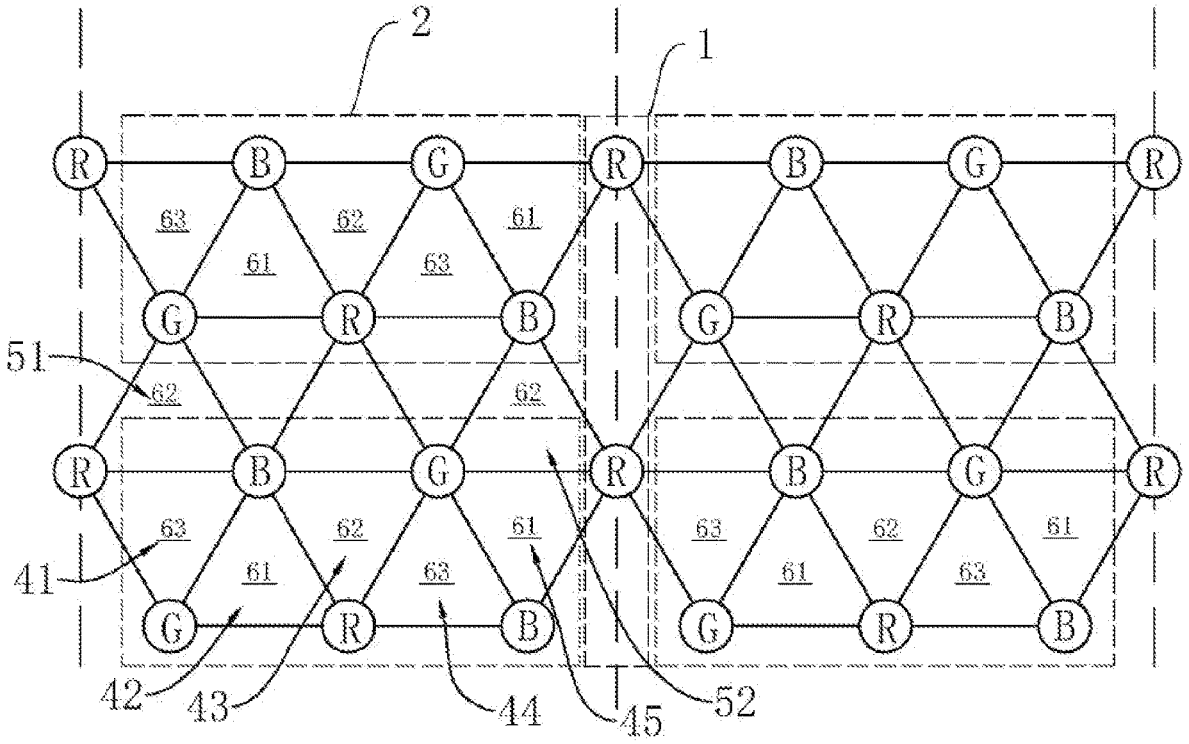
FIG. 6 is another schematic diagram of a flip chip space pixel arrangement structure in an example of the present application.
Figure 7A:
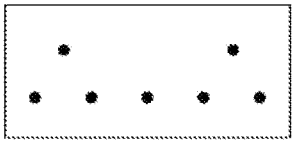
FIG. 7 is used for showing that an original image 7A having high resolution may be split into basic images 7B, 7C, 7D, 7E, 7F, 7G, 7H having low resolution in an example.
Figure 7B:
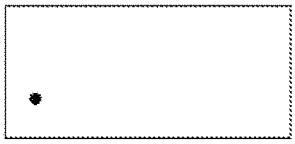
Figure 7C:
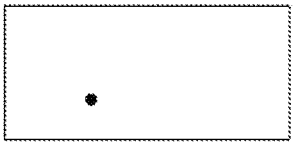
Figure 7D:
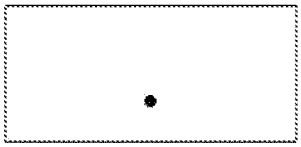
Figure 7E:
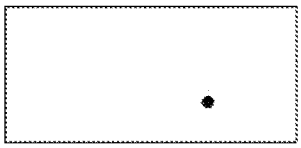
Figure 7F:
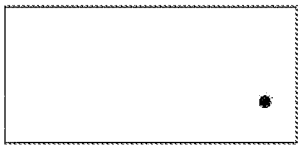
Figure 7G:
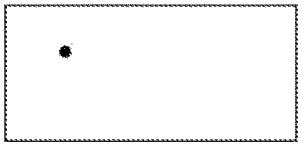
Figure 7H:
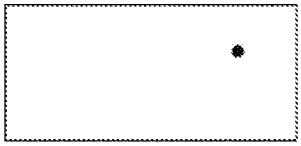

With reference to FIG. 6, on the basis of the above example of the flip chip space pixel arrangement structure, five first type of white light points 4 are sequentially, from left to right, a white light point I 41, a white light point II 42, a white light point III 43, a white light point IV 44, and a white light point V 45, two second type of white light points 5 are sequentially, from left to right, a white light point VI 51 and a white light point VII 52, in fact, the white light point II 42, the white light point III 43 and the white light point VI 44 are separate white light points 301, the white light point I 41 and the white light point V 45 are reconstruction white light points I 302, and the white light point VI 51 and the white light point VII 52 are reconstruction white light points III 304. That is, there is no common sub-pixel between the white light point I 41 and the white light point IV, the white light point V and the white light point VII 52, there is no common sub-pixel between the white light point II 42 and the white light point V and the white light point VII 52, there are common sub-pixels between white light point III 43 and other six white light points, there is no common sub-pixel between the white light point IV 44 and the white light point I and the white light point VI 51, and there is no common sub-pixel between the white light point V 45 and the white light point I, the white light point II and the white light point VI 51. In addition, two white light point groups that are adjacent to each other left and right share one first pixel point. That is, there is the common sub-pixel between the white light point V 45 of the white light point group on a left side and the white light point I 41 of the white light point group on a right side.

S2, on the basis of a pixel acquisition algorithm, sample a single frame of original image having high resolution into seven basic images having low resolution, a pixel of each of the basic images being mapped in one-to-one correspondence with the same white light point of each of the white light point groups.

By means of the pixel acquisition algorithm, the original image having high resolution is split into seven basic images having low resolution, and the seven basic images having low resolution are combined to form an image having high resolution. In order to improve display efficiency, the seven split basic images correspond to different pixels of the original image and correspond to different white light points of the white light point group respectively. Specifically, after each of the basic images is properly translated, the vast majority of pixel points may overlap pixel points of other basic images. For example, with reference to FIG. 7, an original image having high resolution 7A may be split into basic images 7B, 7C, 7D, 7E, 7F, 7G, 7H having low resolution, a pixel point of each of the basic images corresponds to a white light point in the same position of each of the white light point groups, and thus it may be seen that the white light points in each of images of FIG. 7 are uniformly distributed as a whole. It should be noted that FIG. 7 is merely used for showing a method for splitting an original image having high resolution into seven images having low resolution in a certain example, and does not specifically limit a specific form of splitting. For example, pixels drawn in FIG. 7 are non-uniform and fully split, in practice, a single pixel of the original image may be repeatedly split onto a plurality of basic images, and brightness is reduced only for the repeated pixels, so as to make overlapping pixel brightness correspond to the original image after the basic images are overlapped. Of course, it is also possible to discard some pixels of the original image during sampling, instead of displaying the pixels on the basic image.

S3, on the basis of a determination strategy, formulate display orders of the basic images, the single frame of original image corresponding to three display orders, and each of the display orders corresponding to one or more of the basic images.

The first type of white light points 4 and the second type of white light points 5 may turn on in different display orders. For example, in the display order I, two first type of white light points 4 that are non-adjacent simultaneously turn on, and are used for displaying two basic images. The seven images are displayed by the white light point group by means of the three display orders. For example, on the basis of the above example of the flip chip space pixel arrangement structure, white light points displayed at the order I 61 are the white light point II 42 and the white light point V 45, white light points displayed at the order II 62 are the white light point III 43, the white light point VI 51 and the white light point VII 52, white light points displayed at the order III 63 are the white light point I 41 and the white light point IV 44. Partial images corresponding to the white light point VI 51 and the white light point VII 52 of the order II 62 are finely adjusted on the basis of the determination strategy, to combine the images at the order I 61 or the order III 63 for display.

Specifically, in some examples, the determination strategy includes:

determine whether a color difference between the corresponding first pixel point and the second pixel point adjacent to the first pixel point in the basic image is greater than a preset threshold; under the condition of determining that the color difference between the corresponding first pixel point and the second pixel point adjacent to the first pixel point in the basic image is greater than the preset threshold, adjust brightness of three sub-pixels forming the first type of white light points (4) of the order II 62 and brightness of the two adjacent first pixel points, to make a color of the second type of white light points (5) formed by the five sub-pixel points correspond to the basic image; and otherwise, cancel display of the second pixel point by the second type of white light points 5 in the order II 62, and turn up display brightness of the first type of white light points 4 corresponding to the similar pixel point, the first pixel point and the second pixel point being a pixel point of the first type of white light points 4 in the order I 61 in the white light point group corresponding to the same frame of original image, and a pixel point of the second type of white light points 5 in the order II 62 in the white light point group corresponding to the same frame of original image respectively, and the similar pixel point being the first pixel point.

The pixel is usually a chip for controlling the scanning drive circuit since the pixel is driven by a driver. In order to reduce cost, reduce heat generation, and increase a pixel density, the present solution combines a plurality of monochromatic sub-pixels into a pixel set, and the single driver is used for driving the single pixel set. That is, as long as pixel points of the seven basic images sequentially correspond to the white light points of the white light point group, and the single driver may sequentially perform driving without separately driving. The driver is correspondingly provided with a buffer, and the buffer may store the seven frame of basic image split from each frame of original image. Since there is mutual interference of the pixel points when the second type of white light points 5 are in use, a controller reads, before display, two interfering basic images corresponding to the order I 61 and the order II 62 from the buffer for comparison, so as determine whether the color difference between the first pixel point and the second pixel point at an interference position is greater than the preset threshold, and if so, a sub-pixel common by the first type of white light points 4 of the order II 62 and the second type of white light points 5 of the order II 62 is decided, and light intensity of the sub-pixel is modulated to reduce color shift, which is based on the principle that the human eyes are limited in resolution, and may mix adjacent pixel points, thereby generating illusion of a high color level. By the same reasoning, if the difference is small, display brightness of the original first pixel point is improved, and similar to the principle of pulse-width modulation (PWM), two adjacent frames each use single brightness, and use double brightness at intervals, and a visual effect is actually extremely close. By combining display of the similar pixel point, computation of the controller may be reduced, and the number of times of charging and discharging of a circuit may be reduced, thereby achieving the effect of power saving.

For example, when light intensity of the blue light sub-pixel corresponding to a pixel of the basic image corresponding to the white light point II 42 is 100 units, light intensity of the blue light sub-pixel corresponding to a pixel of the basic image corresponding to the white light point VI 51 is 101 units, and the preset threshold is 10 units, it is determined that the color difference between the corresponding first pixel point and the second pixel point adjacent to the first pixel point in the basic image is less than the preset threshold, and further, during display, display of the white light point VI 51 in the order II 62 corresponding to the frame of original image is canceled, and light intensity of the white light point II 42 at the order I 61 is adjusted to 200 units. For another example, when light intensity of the blue light sub-pixel corresponding to a pixel of the basic image corresponding to the white light point II 42 is 100 units, light intensity of the blue light sub-pixel corresponding to a pixel of the basic image of the white light point VI 51 is 120 units, and the preset threshold is 10 units, it is determined that the color difference between the corresponding first pixel point and the second pixel point adjacent to the first pixel point in the basic image is greater than the preset threshold, and therefore in the order II 62, during display, the white light point VI 51 in the order II 62 corresponding to the frame of original image continues being displayed, but light intensity of the common blue light sub-pixel of the white light point III 43 and the white light point VI 51 is adjusted.

In another examples, the determination strategy includes:

determine whether a color difference between a corresponding third pixel point and the second pixel point adjacent to the third pixel point in the basic image is greater than a preset threshold; under the condition of determining that the color difference between the corresponding third pixel point and the second pixel point adjacent to the third pixel point in the basic image is greater than the preset threshold, adjust brightness of three sub-pixels forming the first type of white light points 4 of the order II 62 and brightness of the two adjacent third pixel points, to make a color of the second type of white light points 5 formed by the five sub-pixel points correspond to the basic image; and otherwise, cancel display of the second pixel point by the second type of white light points 5 in the order II 62, and turn up display brightness of the first type of white light points 4 corresponding to the similar pixel point, the third pixel point and the second pixel point being a pixel point of the first type of white light points 4 in the order III 63 in the white light point group corresponding to the same frame of original image, and a pixel point of the second type of white light points 5 in the order II 62 in the white light point group corresponding to the same frame of original image respectively, and the similar pixel point being the third pixel point.

In another examples, the determination strategy includes:

determine whether a color difference between a corresponding third pixel point and the second pixel point adjacent to the third pixel point in the basic image is greater than a preset threshold, and determine whether a color difference between the corresponding first pixel point and the second pixel point adjacent to the first pixel point in the basic image is greater than a preset threshold; under the condition of determining that the color difference between the corresponding third pixel point and the second pixel point adjacent to the third pixel point in the basic image is greater than the preset threshold, and the color difference between the corresponding first pixel point and the second pixel point adjacent to the first pixel point in the basic image is greater than the preset threshold, adjust brightness of three sub-pixels forming the first type of white light points (4) of the order II 62 and brightness of the two adjacent third pixel points, to make a color of the second type of white light points 5 formed by the five sub-pixel points correspond to the basic image; and otherwise, cancel display of the second pixel point by the second type of white light points 5 in the order II 62, and turn up display brightness of the first type of white light points 4 corresponding to the similar pixel point, the first pixel point, the second pixel point and the third pixel point being a pixel point of the first type of white light points 4 in the order I 61 in the white light point group corresponding to the same frame of original image, a pixel point of the second type of white light points 5 in the order II 62 in the white light point group corresponding to the same frame of original image, and a pixel point of the first type of white light points 4 in the order III 63 in the white light point group corresponding to the same frame of original image respectively, and the similar pixel point being a pixel point whose the color difference between the similar pixel point and the second pixel point is less than or equal to the preset threshold in the order I 61 or the order III 63.

The above two determination strategies are integrated, interfering pixel points produced by the basic images corresponding to the light emitting order I, the second light emitting order II, and the third light emitting order III are determined at the same time, so as to combine display of the similar pixel point as much as possible, reduce computation of the controller, and reduce the number of times of charging and discharging of the circuit, thereby achieving the effect of power saving.

Figure 8:
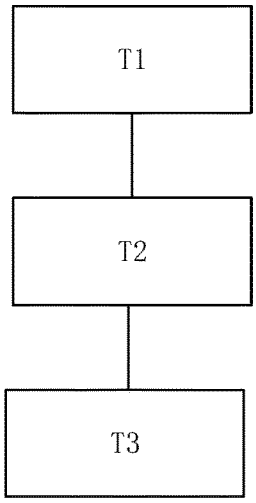
FIG. 8 is a block diagram of a pixel light intensity modulation method in an example of the present application.

Although in different examples, the determination strategy may be different in manifestation, in the determination steps, the adjusting brightness of three sub-pixels forming the first type of white light points 4 of the order II 62 and brightness of the two adjacent third pixel points, to make a color of the second type of white light points 5 formed by the five sub-pixel points correspond to the basic image includes, in combination with FIG. 8:

T1, obtain mapping relations between three primary colors of the second pixel point and the similar pixel point and three primary color sub-pixels of corresponding white light points;

T2, obtain primary color rendering data of a three primary color sub-pixel of each of white light points of the order II 62 on the basic image, add primary color rendering data corresponding to common sub-pixels of the white light points, and then divide a sum by 2 to obtain primary color rendering data of the common sub-pixel in the order II 62; and T3, on the basis of a scanning drive circuit, transmit adjusted sub-pixel point color rendering data and unadjusted sub-pixel point color rendering data of each of the white light points in the order II 62 to the display screen, so as to control each of the corresponding white light points to emit light.

In two interfering white light points, there are four independent sub-pixels, and one sub-pixel (i.e., the interfering sub-pixel) common by the first type of white light points 4 and the second type of white light points 5, the primary color rendering data of the two basic images corresponding to the two white light points is obtained, and the common sub-pixel is displayed as an average value of the color rendering data of the two basic images. In actual use, color information that may be received by the eyes is an average value of emitted light in a period of time, and therefore by means of the method, accuracy of performance of the color may be improved while the pixel density is increased.

The above example is followed, when light intensity of the blue light sub-pixel corresponding to a pixel of the basic image corresponding to the white light point II 42 is 100 units, light intensity of the blue light sub-pixel corresponding to a pixel of the basic image pixel of white light point VI 51 is 120 units, and the preset threshold is 10 units, it is determined that the color difference between the corresponding first pixel point and the second pixel point adjacent to the first pixel point in the basic image is greater than the preset threshold, and therefore in the order II 62, during display, the white light point VI 51 in the order II 62 corresponding to the frame of original image continues being displayed, but light intensity of the blue light sub-pixel common by the white light point III 43 and the white light point VI 51 is adjusted, and therefore the light intensity of the blue light sub-pixel is adjusted to (100+120)/2=110 units.

S4. on the basis of the display order, sequentially displaying each of the images having low resolution in a single frame duration, to complete sub-pixel reconstruction of the flip chip space pixel arrangement structure.

Since a refresh rate of the basic image is high, human eyes generate a residual image when receiving the basic image, such that images of the three display orders are overlapped together, and therefore a high resolution effect is generated by means of the high refresh rate. Specifically, a display duration of each of the images having low resolution may be different. Illustratively, in some examples, the refresh rate of the original image is 60 Hz, and the refresh rate of the basic image is 180 Hz. That is, in the order I 61, the basic images corresponding to the white light point II 42 and the white light point V 45 are refreshed, in the order II 62, the basic images corresponding to the white light point III 43, the white light point VI 51 and the white light point VII 52 are refreshed, and in the order III 63, the base images corresponding to the white light point I 41 and the white light point IV 44 are refreshed.

An example of the present application further discloses a pixel multiplexing system based on a flip chip space pixel arrangement structure. The pixel multiplexing system includes: a partitioning module, which is used for equidistantly dividing, in rows and columns, an LED display screen into a plurality of first pixel points and a plurality of second element sets 2 that are arranged in a uniform array manner, to form a light emitting tube array, the light emitting tube array forming a plurality of white light point groups, and each of the white light point groups including three first type of white light points 4 formed inside each of the second element sets 2, two first type of white light points 4 formed between the first pixel point and the second pixel set 2 that are adjacent to each other, and two second type of white light points 5 formed between the two adjacent second element sets 2;

a splitting module, which is used for sampling, on the basis of a pixel acquisition algorithm, a single frame of original image having high resolution into seven basic images having low resolution, a pixel of each of the basic images being mapped in one-to-one correspondence with the same white light point of each of the white light point groups;

a sorting module, which is used for on the basis of a determination strategy, formulating display orders of the basic images, the single frame of original image corresponding to three display orders, and each of the display orders corresponding to one or more of the basic images; and a control module, which is used for sequentially displaying, on the basis of the display orders, each of the images having low resolution in a single frame duration, to complete sub-pixel reconstruction of the flip chip space pixel arrangement structure.

An example of the present application further provides a host. The host includes a memory and a processor, where the memory stores a computer program loadable by the processor and executing the pixel multiplexing method as above. An execution body of the method of this example may be a control apparatus. The control apparatus is arranged on the host, and a current device may be an electronic device such as a mobile phone, a tablet, or a laptop having a wireless fidelity (WIFI) function. An execution body of a method of this example may also be directly a central processing unit (CPU) of the electronic device.

An example of the present application further discloses a readable storage medium. The readable storage medium stores a computer program loadable by a processor and executing the pixel multiplexing method as above. From the description of the above embodiments, it will be apparent to those skilled in the art that the methods of the above examples may be implemented by means of software plus a necessary general-purpose hardware platform, and of course may also be implemented by means of hardware, but in many cases the former is a better embodiment. On the basis of the understanding, the technical solution of the present application may be embodied in a form of a software product in essence or a part contributing to the prior art, and the computer software product is stored in the storage medium (for example, a read only memory (ROM)/random access memory (RAM), a magnetic disk and an optical disk) as above, and includes several instructions for enabling a device (like a mobile phone, a computer, a server, a controlled terminal, or a network device) to execute the method of each example of the present application.

What are described above are all preferred examples of the present application, and are not intended to limit the scope of protection of the present application. Therefore, equivalent changes made according to the structure, shape and principle of the present application should all fall within the scope of protection of the present application.

The invention claimed is:

1. A pixel multiplexing method based on a flip chip space pixel arrangement structure, comprising:

equidistantly dividing, in rows and columns, pixel points of a light emitting diode (LED) display screen into a plurality of first element sets (1) and a plurality of second element sets (2), the plurality of first element sets (1) and the plurality of second element sets(2) being arranged in a uniform array manner, the plurality of first element sets (1) and the plurality of second element sets (2) forming a light emitting tube array, the first element set comprising a plurality of first pixel points, the second element set comprising a plurality of second pixel points, the light emitting tube array being provided with a plurality of white light point groups, the white light point group comprising a first type of white light points (4) and a second type of white light points (5), the first type of white light points (4) comprising three white light points arranged inside the second element set (2), and two white light points arranged between the first pixel point and the second element set (2) that are adjacent to each other, and the second type of white light points (5) comprising two white light points arranged between the two adjacent second element sets (2);

on the basis of a pixel acquisition algorithm, sampling an original image into seven single frame of basic images having low resolution lower than that of the original image, a pixel of each of the basic images being mapped in one-to-one correspondence with the same white light point of each of the white light point groups;

on the basis of a determination strategy, formulating display orders of the basic images, the single frame of original image corresponding to three display orders, each of the display orders corresponding to one or more of the basic images, the display orders comprising an order I (61), an order II (62) and an order III (63), and the determination strategy being to determine dry pixel points generated by the basic images corresponding to the order I, the order II and the order III at the same time; and according to the display orders, sequentially displaying each of the basic images in a single frame duration, to complete sub-pixel reconstruction of the flip chip space pixel arrangement structure.

2. The pixel multiplexing method based on a flip chip space pixel arrangement structure according to claim 1, wherein the determination strategy comprises:

determining whether a color difference between the corresponding first pixel point and the second pixel point adjacent to the first pixel point in the basic image is greater than a preset threshold;

under the condition of determining that the color difference between the corresponding first pixel point and the second pixel point adjacent to the first pixel point in the basic image is greater than the preset threshold, adjusting brightness of three sub-pixels of the first type of white light points (4) and brightness of the two adjacent first pixel points in the order II (62), to make a color of the second type of white light points (5) formed by the five sub-pixel points correspond to the basic image; and otherwise, canceling display of the second pixel point by the second type of white light points (5) in the order II (62), temporarily denoting the first pixel point as a similar pixel point, and adjusting display brightness of the first type of white light points (4) corresponding to the similar pixel point, an adjustment mode being to turn brightness up, the first pixel point being a pixel point of the first type of white light points (4) in the order I (61) in the white light point group corresponding to the same frame of original image, and the second pixel point being a pixel point of the second type of white light points (5) in the order II (62) in the white light point group corresponding to the same frame of original image.

3. The pixel multiplexing method based on a flip chip space pixel arrangement structure according to claim 1, wherein the determination strategy comprises:

determining whether a color difference between a corresponding third pixel point and the second pixel point adjacent to the third pixel point in the basic image is greater than a preset threshold;

under the condition of determining that the color difference between the corresponding third pixel point and the second pixel point adjacent to the third pixel point in the basic image is greater than the preset threshold, adjusting brightness of three sub-pixels of the first type of white light points (4) and brightness of the two adjacent third pixel points in the order II (62), to make a color of the second type of white light points (5) formed by the five sub-pixel points correspond to the basic image; and otherwise, canceling display of the second pixel point by the second type of white light points (5) in the order II (62), temporarily denoting the third pixel point as a similar pixel point, and adjusting display brightness of the first type of white light points (4) corresponding to the similar pixel point, an adjustment mode being to turn brightness up, the second pixel point being a pixel point of the second type of white light points (5) in the order II (62) in the white light point group corresponding to the same frame of original image, and the third pixel point being a pixel point of the first type of white light points (4) in the order III (63) in the white light point group corresponding to the same frame of original image.

4. The pixel multiplexing method based on a flip chip space pixel arrangement structure according to claim 1, wherein the determination strategy comprises:

determining whether a color difference between a corresponding third pixel point and the second pixel point adjacent to the third pixel point in the basic image is greater than a preset threshold, and determining whether a color difference between the corresponding first pixel point and the second pixel point adjacent to the first pixel point in the basic image is greater than a preset threshold;

under the condition of determining that the color difference between the corresponding third pixel point and the second pixel point adjacent to the third pixel point in the basic image is greater than the preset threshold, and the color difference between the corresponding first pixel point and the second pixel point adjacent to the first pixel point in the basic image is greater than the preset threshold, adjusting brightness of three sub-pixels of the first type of white light points (4) and brightness of the two adjacent third pixel points in the order II (62), to make a color of the second type of white light points (5) formed by the five sub-pixel points correspond to the basic image; and under the condition that any one or two of determinations are no, canceling display of the second pixel point by the second type of white light points (5) in the order II (62), comparing a color difference between a pixel point in the order I (61) or the order III (63) and the second pixel point, temporarily denoting a pixel point having a color difference comparison value less than or equal to a preset threshold as a similar pixel point, and adjusting display brightness of the first type of white light points (4) corresponding to the similar pixel point, an adjustment mode being to turn brightness up, the first pixel point being a pixel point of the first type of white light points (4) in the order I (61) in the white light point group corresponding to the same frame of original image, the second pixel point being a pixel point of the second type of white light points (5) in the order II (62) in the white light point group corresponding to the same frame of original image, and the third pixel point being a pixel point of the first type of white light points (4) in the order III (63) in the white light point group corresponding to the same frame of original image.

5. The pixel multiplexing method based on a flip chip space pixel arrangement structure according to claim 4, wherein the adjusting brightness of three sub-pixels of the first type of white light points (4) and brightness of the two adjacent third pixel points in the order II (62), to make a color of the second type of white light points (5) formed by the five sub-pixel points correspond to the basic image comprises:

obtaining mapping relations between three primary colors of the second pixel point and the similar pixel point and three primary color sub-pixels of corresponding white light points;

obtaining primary color rendering data of a three primary color sub-pixel of each of white light points of the order II (62) on the basic image, adding primary color rendering data corresponding to common sub-pixels of the white light points, and then dividing a sum by 2 to obtain primary color rendering data of the common sub-pixel in the order II (62); and on the basis of a scanning drive circuit, transmitting adjusted sub-pixel point color rendering data and unadjusted sub-pixel point color rendering data of each of the white light points in the order II (62) to the display screen, so as to control each of the corresponding white light points to emit light.

6. A flip chip space pixel arrangement structure, suitable for the pixel multiplexing method based on a flip chip space pixel arrangement structure of claim 1 and comprising: several first element sets (1) and several second element sets (2), wherein the first element set (1) comprises several first pixel points arranged continuously and longitudinally, the first pixel point being denoted as a pixel A, and the second element set (2) comprises a center pixel point (201), a first unit pixel (202), a second unit pixel (203), a third unit pixel (204) and a fourth unit pixel (205), a first sub-pixel, a second sub-pixel, a third sub-pixel and a fourth sub-pixel being sequentially distributed on a semi-circular arc established by taking the center pixel point (201) as a circle center, the sub-pixel on the semi-circular arc being denoted as a circular arc sub-pixel, the center pixel point (201), the first unit pixel (202), the second unit pixel (203), the third unit pixel (204) and the fourth unit pixel (205) being denoted as a pixel A, a pixel B, a pixel C, a pixel B and a pixel C respectively, and a red light sub-pixel, a green light sub-pixel and a blue light sub-pixel each corresponding to one of the pixel A, the pixel B and the pixel C;

three separate white light points (301) are arranged in each of the second element sets (2), the separate white light point (301) is formed by cooperation of the center pixel point (201) and any one of the circular arc sub-pixels, and the circular arc sub-pixel participating in composition is adjacent to the center pixel point (201);

the second element set (2) is arranged between the two adjacent first element sets (1), the first unit pixel (202) and the second unit pixel (203), the third unit pixel (204) and the fourth unit pixel (205) are used as reconstruction pairs respectively, the flip chip space pixel arrangement structure forms a reconstruction location on one side of the reconstruction pair away from the center pixel point (201), and the pixel A in the first element set (1) is arranged on the reconstruction location, and match the reconstruction pair adjacent to the pixel A, to form a reconstruction white light point I (302); and control modes of the first element set (1) and the second element set (2) are both separate electric control, to further control an on-off order and frequency of the separate white light point (301) and the reconstruction white light point I (302).

7. The flip chip space pixel arrangement structure according to claim 6, wherein the second element set (2) is arranged between the two adjacent first element sets (1), and is arranged in a single-row longitudinal manner;

in the two second element sets (2) vertically adjacent to each other, the first unit pixel (202), the second unit pixel (203), the third unit pixel (204) and the fourth unit pixel (205) of the second element set (2) located above and the second unit pixel (203) and the third unit pixel (204) of the second element set (2) located below form a shape of a regular hexagon, four sub-pixels on a lower side of the regular hexagon match the pixel A at a center of the regular hexagon, to form three reconstruction white light points II (303), and the two adjacent second element sets (2) control on-off of pixels inside the second element sets respectively, to further control an on-off order and frequency of the reconstruction white light point II (303); and the four sub-pixels on the lower side of the regular hexagon are divided into two matched pairs according to left and right pairing, the matched pair matches the pixel A in the reconstruction location adjacent to the matched pair, to form a reconstruction white light point III (304), the two adjacent second element sets (2) control on-off of pixels inside the second element sets respectively, and the first element set (1) controls on-off of the pixel A inside the first element set, to further control on-off of the reconstruction white light point III (304).

8. A pixel multiplexing system based on a flip chip space pixel arrangement structure, using the pixel multiplexing method based on a flip chip space pixel arrangement structure of claim 1, and comprising:

a partitioning module, the partitioning module being used for equidistantly dividing, in rows and columns, an LED display screen into several first element sets (1) and several second element sets (2) that are arranged in a uniform array manner, to form a light emitting tube array, the light emitting tube array forming a plurality of white light point groups, the white light point group comprising a first type of white light points (4) and a second type of white light points (5), the first type of white light points (4) comprising three white light points arranged inside the second element set (2), and two white light points arranged between the first pixel point and the second element set (2) that are adjacent to each other, and the second type of white light points (5) comprising two white light points arranged between the two adjacent second element sets (2);

a splitting module, the splitting module sampling, by means of a pixel acquisition algorithm, an original image into seven single frame of basic images having low resolution lower than that of the original image, and a pixel of each of the basic images being mapped in one-to-one correspondence with the same white light point of each of the white light point groups;

a sorting module, the sorting module formulating display orders of the basic images by means of a determination strategy, the single frame of original image corresponding to three display orders, each of the display orders corresponding to one or more of the basic images, the display orders comprising an order I, an order II and an order III, and the determination strategy being to determine dry pixel points generated by the basic images corresponding to the order I, the order II and the order III at the same time; and a control module, the control module sequentially displaying, by means of the display orders, each of the basic images in a single frame duration, to complete sub-pixel reconstruction of the flip chip space pixel arrangement structure.

9. An apparatus, comprising a memory and a processor, wherein the memory stores a computer program loadable by the processor and executing the pixel multiplexing method based on a flip chip space pixel arrangement structure of claim 1.

10. A non-transitory readable storage medium, storing a computer program loadable and executable by a processor, wherein the computer program is the pixel multiplexing method based on a flip chip space pixel arrangement structure of claim 1.

* * * * *